US008896402B2

(12) United States Patent
Soukup

(10) Patent No.: US 8,896,402 B2
(45) Date of Patent: Nov. 25, 2014

(54) APPARATUS FOR SUPPORTING A HINGED ARMATURE

(75) Inventor: Michael Soukup, Kümmersbruck (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 13/599,375

(22) Filed: Aug. 30, 2012

(65) Prior Publication Data

US 2013/0049907 A1 Feb. 28, 2013

(30) Foreign Application Priority Data

Aug. 31, 2011 (DE) ..... 10 2011 081 854

(51) Int. Cl.

| | |
|---|---|
| ***H01H 83/00*** | (2006.01) |
| ***H01H 50/26*** | (2006.01) |
| ***H01H 50/34*** | (2006.01) |
| ***H01H 50/36*** | (2006.01) |

(52) U.S. Cl.

CPC ..... *H01H 50/26* (2013.01); *H01H 50/34* (2013.01); *H01H 50/36* (2013.01)

USPC ..... 335/21; 335/16

(58) Field of Classification Search

USPC ..... 335/21, 16

See application file for complete search history.

(56) References Cited

U.S. PATENT DOCUMENTS

| | | | | | |
|---|---|---|---|---|---|
| 3,568,008 | A | * | 3/1971 | Tanimura et al. | 361/155 |
| 4,048,600 | A | * | 9/1977 | Dietrich | 335/128 |
| 4,378,546 | A | | 3/1983 | Altemir | |
| 4,616,200 | A | * | 10/1986 | Fixemer et al. | 335/35 |
| 4,682,133 | A | * | 7/1987 | Kern | 335/119 |
| 4,972,166 | A | * | 11/1990 | Mitsch et al. | 335/128 |
| 5,063,366 | A | * | 11/1991 | Edelhaeuser et al. | 335/271 |
| 5,694,101 | A | * | 12/1997 | Lavelle et al. | 335/172 |
| 7,106,154 | B2 | * | 9/2006 | Takano et al. | 335/129 |
| 2002/0135446 | A1 | * | 9/2002 | Takano et al. | 335/128 |
| 2005/0040920 | A1 | * | 2/2005 | Takano et al. | 335/128 |

FOREIGN PATENT DOCUMENTS

| | | | |
|---|---|---|---|
| AT | 394283 | T | 5/2008 |
| DE | 1017288 | B | 10/1957 |
| DE | 1614172 | A1 | 5/1970 |
| DE | 2219345 | A1 | 11/1973 |
| DE | 3008295 | A1 | 9/1981 |
| DE | 102008012940 | A1 | 9/2009 |

OTHER PUBLICATIONS

EP1526054 (A1) corresponding to AT394283 (T).

German Office Action for German Application No. DE 10 2011 081 854.5 dated Oct. 18, 2011.

Priority Document German Application No. 10 2011 081 854.5 filed Aug. 31, 2011.

* cited by examiner

*Primary Examiner* — Shawki S Ismail
*Assistant Examiner* — Lisa Homza
(74) *Attorney, Agent, or Firm* — Harness, Dickey & Pierce, P.L.C.

(57) ABSTRACT

An apparatus is disclosed, which includes a hinged armature and a yoke. In at least one embodiment, the hinged armature is supported in a cutout in the yoke and can pivot between at least two positions, the cutout in the yoke having an edge, on which the hinged armature is supported.

15 Claims, 3 Drawing Sheets

APPARATUS FOR SUPPORTING A HINGED ARMATURE

PRIORITY STATEMENT

The present application hereby claims priority under 35 U.S.C. §119 to German patent application number DE 102011081854.5 filed Aug. 31, 2011, the entire contents of which are hereby incorporated herein by reference.

FIELD

The present invention generally relates to an apparatus for a hinged armature.

BACKGROUND

Magnetic trip units, which are used in electric circuit breakers and comprise a yoke and a hinged armature, are known from the prior art. Trip units are used to monitor a current flowing in an electric line and to trip a circuit breaker in the event of a so-called overcurrent, said circuit breaker interrupting the current flow in the monitored line. An overcurrent here is a current with a current strength which is so far above the rated current strength of the monitored line and the electrical devices connected thereto that there is a risk of damage to the devices or the line itself due to the heat produced. A trip unit is referred to as a magnetic trip unit, if the circuit breaker is tripped by the trip unit using magnetic forces.

One class of electric circuit breakers is what are known as compact power circuit breakers, which can typically switch currents of 10 A to approx. 2500 A and fault currents up to many times the rated current. Power circuit breakers are typically accommodated in an enclosing housing. The individual current phases can be switched in what are known as pole cartridges. To this end a pole cartridge comprises a housing, in which a moving contact and a fixed contact are accommodated, which can be mechanically separated and brought together to switch the currents on and off.

When the moving and fixed contacts of a pole cartridge are separated, an arc is produced, which is extinguished in an extinction chamber. The arc ionizes the gas in the extinction chamber and produces an overpressure in the extinction chamber, which is equivalent to the arc energy. Power circuit breakers are also known, which do not contain pole cartridges but do contain moving and fixed contacts which are otherwise shielded in their enclosing housing.

Power circuit breakers typically use magnetic trip units for instant short circuit tripping. To this end the current path passes through a magnet system so that a magnetic field action and thus a force action can be achieved on a magnetic or hinged armature. The current-carrying system is passed through an arrangement of magnetic bracket (yoke) and hinged armature. The hinged armature here is supported on the side of the yoke so that it can flip closed due to the magnetic forces.

To adjust the magnetic trip unit a defined force has to be applied by the yoke to the hinged armature in all positions of the magnetic trip unit. It is therefore necessary to keep the friction and support of the hinged armature constant over the life of the power circuit breaker.

SUMMARY

An apparatus for supporting a hinged armature is provided, which allows a defined and constant friction and support of the hinged armature.

To this end, the apparatus of at least one embodiment comprises a hinged armature and a yoke, the hinged armature being supported in a cutout in the yoke and being able to pivot between at least two positions, the cutout in the yoke comprising an edge, on which the hinged armature is supported.

An apparatus of at least one embodiment comprises a hinged armature and a yoke, the hinged armature being supported in a cutout in the yoke and being able to pivot between at least two positions, the cutout in the yoke comprising an edge, on which the hinged armature is supported.

BRIEF DESCRIPTION OF THE DRAWINGS

Further advantages and embodiments of the invention are explained below with the aid of example embodiments and with the aid of the drawing, in which.

Figure 1:
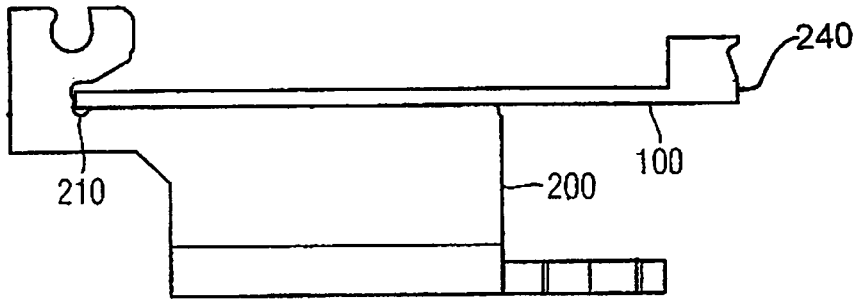
FIG. 1 shows an apparatus including hinged armature and yoke in a first position.

It should be noted that these Figures are intended to illustrate the general characteristics of methods, structure and/or materials utilized in certain example embodiments and to supplement the written description provided below. These drawings are not, however, to scale and may not precisely reflect the precise structural or performance characteristics of any given embodiment, and should not be interpreted as defining or limiting the range of values or properties encompassed by example embodiments. The use of similar or identical reference numbers in the various drawings is intended to indicate the presence of a similar or identical element or feature.

DETAILED DESCRIPTION OF THE EXAMPLE EMBODIMENTS

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

An apparatus of at least one embodiment comprises a hinged armature and a yoke, the hinged armature being supported in a cutout in the yoke and being able to pivot between at least two positions, the cutout in the yoke comprising an edge, on which the hinged armature is supported.

It is advantageous here that the support of the hinged armature on the edge of the yoke allows a defined force to be applied in all switch positions. The friction in the hinged armature support is kept constant by the inventive apparatus over the life of the switch.

In one embodiment of the invention, the cutout in the yoke is formed by two offset, essentially round recesses. The two recesses can particularly advantageously be stamped. Stamping the two recesses allows wear on the production tool to be kept low.

In a further embodiment of the invention, the part of the hinged armature, which is supported in the cutout in the yoke, is essentially configured in a cuboidal cross section.

The surface of the hinged armature, which touches the edge of the cutout in the yoke, can be formed by the outer side surface of the part of the hinged armature configured essentially in a cuboidal cross section. It is advantageous here that the fact that the essentially rectangular outer side surface of the hinged armature is supported on the edge of the yoke guarantees that the hinged armature can move and prevents the hinged armature slipping in the bearing.

In a further embodiment of the invention, the hinged armature runs along a side of the yoke and the hinged armature rests on the yoke in one of the two positions.

The inventive apparatus of at least one embodiment can be part of a trip system. The trip system can be a system for instant short circuit current tripping.

Figure 2:
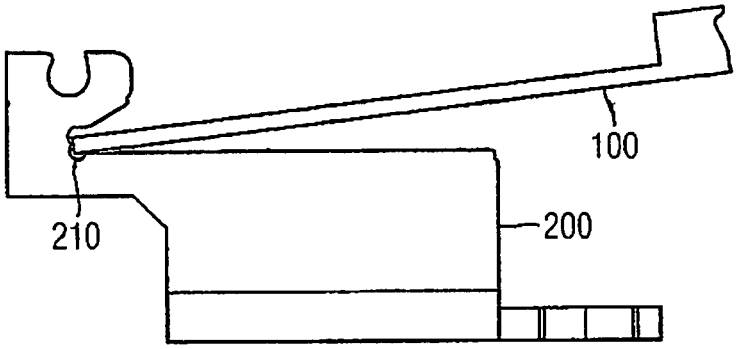
FIG. 2 shows an apparatus including hinged armature and yoke in a second position.

FIGS. 1 and 2 show a conventional magnetic trip unit including hinged armature 100 and yoke 200. The hinged armature 100 is supported in a cutout 210 in the yoke 200, the hinged armature 100 being able to pivot between at least two positions.

FIG. 1 shows the magnetic trip unit including hinged armature 100 having a first edge and yoke 200 in a first position. In this first position the hinged armature 100 runs along a side of the yoke 200, with the hinged armature 100 resting on the upper face of the yoke 200. The hinged armature 100 has been moved into this first position by the magnetic force applied by the yoke 200 to the hinged armature 100. The magnetic force here can be produced by an overcurrent or by a short circuit current.

FIG. 2 shows the hinged armature 100 in a second position. This second position is typically the position, in which the magnetic trip unit is not tripped. There are no magnetic forces applied by the yoke 200 to the hinged armature 100, or such magnetic forces are so small that the hinged armature 100 is not attracted to such a degree by the yoke 200 that it comes to rest as in FIG. 1.

The part of the hinged armature 100 which is supported in the cutout 210 in the yoke 200 can essentially be configured in a cuboidal cross section. The problem then arises for support of the hinged armature 100 that the hinged armature 100 can rest on different points of the cutout 210 in the yoke 200 when pivoting between the at least two positions. In the case of a round bearing point, as shown in the cutout 210 in the yoke 200 in FIGS. 1 and 2, the upper or lower edge of the hinged armature 100 for example can be in contact with the yoke 200. This means that the bearing point is not clearly defined and the force acting on the hinged armature 100 is not constant and is likewise not clearly defined. Similarly the so-called stick-slip effect can mean that the support of the hinged armature 100 in the cutout 210 in the yoke 200 is not defined. The pivot movement of the hinged armature 100 can cause the side surface of the hinged armature 100 supported in the cutout 210 to slip or jump.

Figure 3:
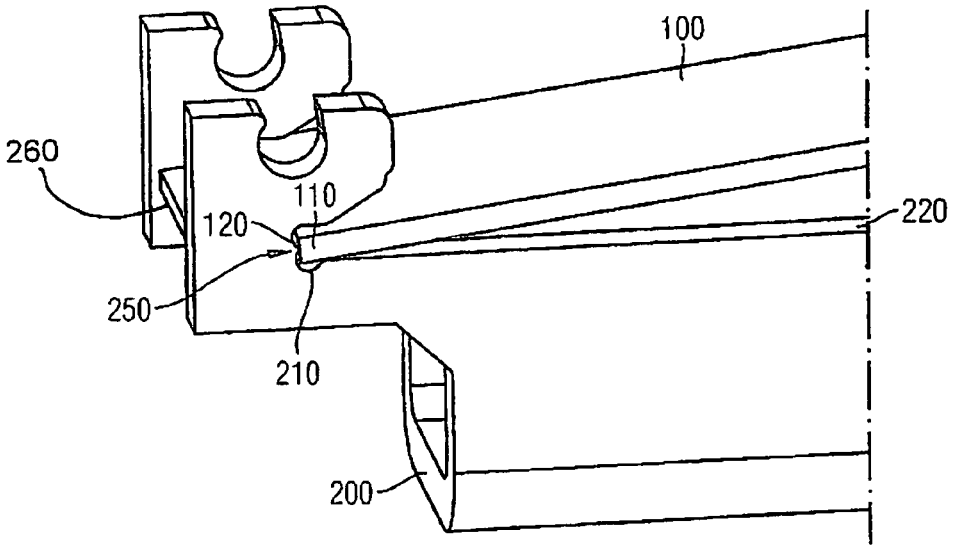
FIG. 3 shows a detailed view of an apparatus including hinged armature and yoke with an edge.

FIG. 3 shows an embodiment of the inventive apparatus comprising a hinged armature 100 having a second edge 260 and a yoke 200, the hinged armature 100 being supported in a cutout 210 in the yoke and being able to pivot between at least two positions. In FIG. 3 the hinged armature 100 is disposed at a distance from the yoke 200 and therefore in the position, in which the magnetic trip unit is not tripped. The cutout 210 in the yoke 200 comprises a third edge 250, on which the hinged armature 100 is supported. This ensures that the hinged armature 100 is supported in an exact and temporally constant manner in the cutout 210 and most importantly the so-called stick-slip effect does not occur in the support. The support of the hinged armature 100 on the edge 250 defined a clear and temporally constant bearing point for the hinged armature 100.

The cutout 210 in the yoke 200 is formed by two offset, essentially round recesses. The two recesses can be stamped. For example a metal strip can be fed to a machine tool with different machining stations, the machining stations comprising different tools. The stamping operations can be performed by two stamps in different machining stations of this machine tool.

The part 110 of the hinged armature 100, which is supported in the cutout 210 in the yoke, is configured according to FIG. 3 essentially in a cuboidal cross section. The surface 120 of the hinged armature 100, which touches the edge 250 of the cutout 210 in the yoke 200, is formed by the outer side surface of the part 110 of the hinged armature 100 configured essentially in a cuboidal cross section. This means that the outer side surface 120 of the hinged armature 100 interacts with the edge 250 of the yoke 200 and forms a bearing. The support can also be referred to as a needle bearing, although the edge 250 means that it is not a punctiform support but a support on a tip/edge extending in a single dimension.

The hinged armature 100 runs along a side 220 of the yoke 200. If there are corresponding magnetic forces, a magnetic force acts on the hinged armature 100 from the side 220 of the yoke 200, drawing it onto the side 220 of the yoke 200.

Figure 4:
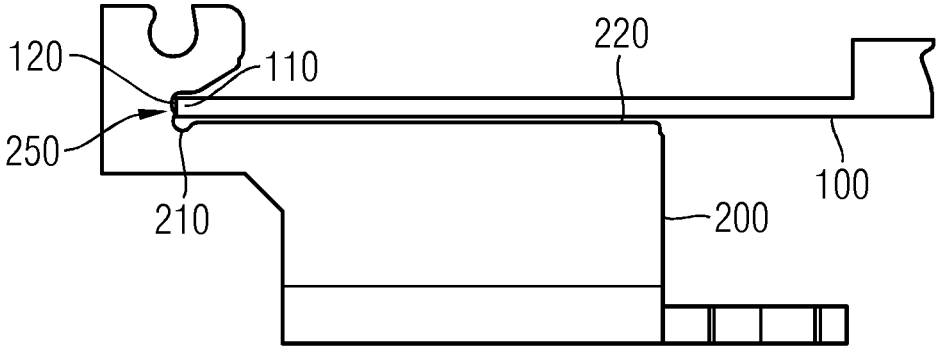
FIG. 4 shows an apparatus including hinged armature and yoke with an edge in a first position.

FIG. 4 shows an embodiment of the inventive apparatus in a first trip position of the magnetic trip unit. The hinged armature 100 runs parallel to the side 220 of the yoke 200 after being attracted by the magnetic forces. The edge 250 is disposed above the side 220 of the yoke 200, ensuring that in the region of the cutout 210 the hinged armature is only supported on the edge 250 and does not rest on the yoke 200. This ensures that the support of the hinged armature 100 is always precisely defined.

Figure 5:
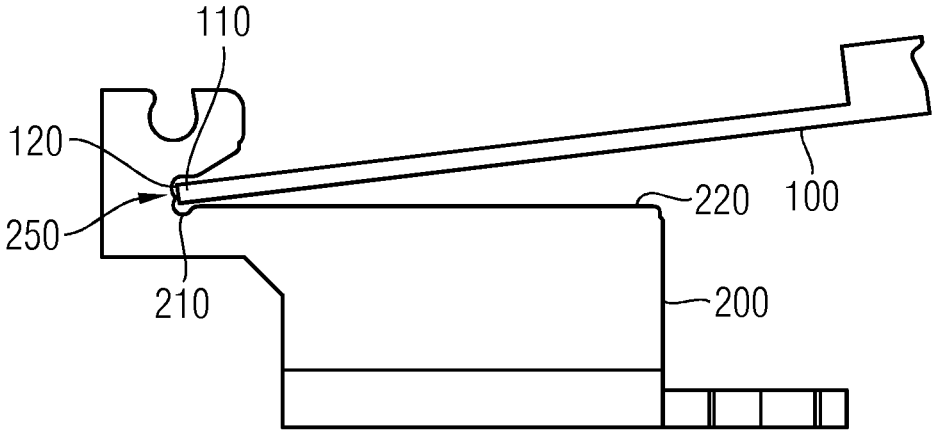
FIG. 5 shows an apparatus including hinged armature and yoke with an edge in a second position.

FIG. 5 shows the hinged armature 100 in the second position, in which the magnetic trip unit is not tripped. This also ensures that the hinged armature 100 is clearly supported on the edge 250 of the cutout 210 in the yoke 200.

Support on the edge 250 means that there is no displacement of the hinged armature 100 during pivoting between the at least two positions, with the result that the distance between hinged armature 100 and yoke 200 is kept constant. This allows much more precise adjustment of the distance between the hinged armature 100 and the yoke 200, and thus of the trip current of the magnetic trip unit.

An embodiment of the inventive apparatus for supporting the hinged armature 100 is simple to produce in terms of manufacturing processes by stamping or drilling and is therefore a cost-neutral solution for improving the support of the hinged armature 100.

The defined, very small bearing surface of the hinged armature 100 on the edge 250 prevents field displacement and thereby a change in the magnetic field during the flip movement. This harmonizes the operating values due to homogenization of the magnetic field over the entire path region. Magnetic field displacements are no longer caused by different bearing surfaces, thereby producing different force actions or operating currents.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An apparatus, comprising:

a hinged armature having a length and a first width and a second width narrower than the first width; and a yoke, the hinged armature being supported in a pair of cutouts in the yoke and being pivotable between at least two positions, wherein each cutout in the yoke is formed by two offset, essentially round recesses and each cutout in the yoke includes an edge at a juncture of the two offset, essentially round recesses on which an end surface of the hinged armature is supported, wherein the first width extends from a first end of the armature to the cutout in the yoke and the second width extends between parallel sides of the yoke.

2. The apparatus of claim 1, wherein the two recesses have been stamped.

3. The apparatus of claim 2, wherein a part of the hinged armature supported in each cutout in the yoke, is configured essentially in a cuboidal cross section.

4. The apparatus of claim 3, wherein a surface of the hinged armature, which touches each edge of the cutout of the yoke, is formed by an outer side surface of the part of the hinged armature configured essentially in a cuboidal cross section.

5. The apparatus of claim 1, wherein a part of the hinged armature supported in each cutout in the yoke, is configured essentially in a cuboidal cross section.

6. The apparatus of claim 5, wherein a surface of the hinged armature, which touches the edge of each cutout of the yoke, is formed by an outer side surface of the part of the hinged armature configured essentially in a cuboidal cross section.

7. The apparatus of claim 1, wherein the hinged armature runs along a side of the yoke and wherein the hinged armature rests on the yoke along a longitudinal side surface of the armature in one of the two positions.

8. The apparatus of claim 7, wherein the armature rests on the yoke along the first width.

9. A trip system, comprising:

an apparatus of claim 1.

10. The trip system of claim 9, wherein the trip system is a system for instant short circuit current tripping.

11. The apparatus of claim 1, wherein a surface of the hinged armature, which touches the edge of each cutout of the yoke, is formed by an outer side surface of the part of the hinged armature configured essentially in a cuboidal cross section.

12. The apparatus of claim 1, wherein the edge is formed sharply to eliminate displacement of the hinged armature during displacement between the at least two positions.

13. The apparatus of claim 1, wherein the edge is a needle bearing.

14. The apparatus of claim 1, wherein the edge is in surface contact with a cutout formed in the armature.

15. The apparatus of claim 1, wherein the hinged armature further includes a first edge at one end, a second edge at another end and a third edge between the first and second edges, the first second and third edges being parallel to one another.

* * * * *